US009234300B2

(12) United States Patent
Law et al.

(10) Patent No.: US 9,234,300 B2
(45) Date of Patent: Jan. 12, 2016

(54) FABRICATION OF LARGE AREA, TEXTURED OIL-LESS FUSING/FIXING SURFACES BY ELECTROSPINNING TECHNIQUE

(75) Inventors: Kock-Yee Law, Penfield, NY (US); Hong Zhao, Webster, NY (US)

(73) Assignee: XEROX CORPORATION, Norwalk, CT (US)

( * ) Notice: Subject to any disclaimer, the term of this patent is extended or adjusted under 35 U.S.C. 154(b) by 1429 days.

(21) Appl. No.: 12/335,933

(22) Filed: Dec. 16, 2008

(65) Prior Publication Data

US 2010/0151245 A1 Jun. 17, 2010

(51) Int. Cl.

| | |
|---|---|
| ***G03G 15/01*** | (2006.01) |
| ***D01D 5/00*** | (2006.01) |
| ***D01F 1/10*** | (2006.01) |
| ***G03G 15/20*** | (2006.01) |

(52) U.S. Cl.

CPC ..... *D01D 5/0007* (2013.01); *D01F 1/10* (2013.01); *G03G 15/2057* (2013.01); *Y10T 428/2933* (2015.01)

(58) Field of Classification Search

CPC ..... B32B 3/10; B32B 5/022; G03G 15/01

USPC ..... 442/79, 80, 394, 397, 401; 399/302, 399/308

See application file for complete search history.

(56) References Cited

U.S. PATENT DOCUMENTS

| | | | | |
|---|---|---|---|---|
| 705,691 | A | 7/1902 | Morton | |
| 5,298,956 | A * | 3/1994 | Mammino et al. | 399/308 |
| 5,978,638 | A * | 11/1999 | Tanaka et al. | 399/302 |
| 6,295,434 | B1 * | 9/2001 | Chang et al. | 399/297 |
| 2006/0292369 | A1 | 12/2006 | Rutledge et al. | |
| 2007/0237947 | A1 | 10/2007 | Gleason et al. | |
| 2008/0035265 | A1 * | 2/2008 | Zaretsky et al. | 156/73.1 |

OTHER PUBLICATIONS

Y.I. Yoon et al., "Superhydrophobicity of PHBV fibrous surface with bead-on-string structure," Journal of Colloid and Interface Science, 320, 2008, pp. 91-95, (Jan. 26, 2008).

D. Li et al., "Electrospinning of Nanofibers: Reinventing the Wheel?," Adv. Mater., 16, No. 14, Jul. 19, 2004, pp. 1153-1170.

A. Greiner et al., "Electrospinning: A Fascinating Method for the Preparation of Ultrathin Fibers," Angew. Chem. Int. Ed., 2007, 46, pp. 5670-5703.

M. Ma et al., "Superhydrophobic surfaces," Current Opinion in Colloid & Interface Science, 11, 2006, pp. 193-202, (Oct. 11, 2006).

M. Ma et al., "Decorated Electrospun Fibers Exhibiting Superhydrophobicity," Adv. Mater., 2007, 19, pp. 255-259, (Jan. 3, 2007).

(Continued)

*Primary Examiner* — Andrew Piziali

(74) *Attorney, Agent, or Firm* — MH2 Technology Law Group LLP

(57) ABSTRACT

In accordance with the invention, there are image forming apparatuses, fuser members, and methods of making fuser members. The fuser member can include a substrate and an electrospun layer disposed over the substrate, the electrospun layer including a structure selected from a group consisting of a fiber-on-fiber structure, a bead-on-fiber structure, and a pop-corn structure, wherein the fuser member includes a top surface that is both hydrophobic and oleophobic.

7 Claims, 7 Drawing Sheets

(56) References Cited

OTHER PUBLICATIONS

E. Burkater, et al., "Superhydrophobic electrosprayed PTFE," Surface and Coatings Technology, 202, 2007, pp. 194-198, (May 13, 2007).

M. Ma et al., "Superhydrophobic Fabrics Produced by Electrospinning and Chemical Vapor Deposition," Macromolecules, 2005, 38, pp. 9742-9748, (Oct. 14, 2005).

M. Zhu et al., "Superhydrophobic surface directly created by electrospinning based on hydrophilic material," J. Mater Sci., 41, 2006, pp. 3793-3797.

* cited by examiner

FABRICATION OF LARGE AREA, TEXTURED OIL-LESS FUSING/FIXING SURFACES BY ELECTROSPINNING TECHNIQUE

FIELD OF THE INVENTION

This invention relates generally to printing devices and, more particularly, to oil-less fusing subsystems and methods of using them.

BACKGROUND OF THE INVENTION

In an electrophotographic printing process, a toner image on a media is fixed by feeding the media through a nip formed by a fuser member and a pressure member in a fuser subsystem and heating the fusing nip, such that the toner image on the media contacts a surface of the fuser member. The heating causes the toner to become tacky and adhere to the media. However, the toner particles of the toner image can stick to the fuser member besides adhering to the media, resulting in an image offset. If the offset image on the fuser is not cleaned, it may print onto the medium in the next revolution and result in unwanted image defects on the print. To overcome this, conventional fusing technologies apply release agents/fuser oils to the fuser member during the fusing operation. Another approach to circumvent image offsetting is the use of polymeric release agents in the toner, e.g., in oil-less fusing. Furthermore, in oil-less fusing, wax is used in toners to aid in the release of the toner image. Oil-less fuser surfaces are generally made of the Teflon® family of polymers, for example, PTFE, PFA due to their thermal and chemical stability, low surface energy and good releasing properties. Although, a smooth Teflon® fuser surface is hydrophobic (water contact angle ~110°), it is oleophilic (hexadecane contact angle ~43°). This oleophilicity makes the transfer of wax to the Teflon® surface favorable during oil-less fusing, leading to fuser contamination by toner materials and wax ghosting. This oleophilicity also leads to robustness issues related to release and stripping over the life of the fuser because of the natural affinity of organic materials.

Thus, there is a need to overcome these and other problems of the prior art and to provide an oleophobic and hydrophobic fuser surface in an oil-less fusing technology to enable robust, offset free, ghost-free oil-less fusing.

SUMMARY OF THE INVENTION

In accordance with various embodiments, there is a fuser subsystem including a fuser member. The fuser member can include a substrate and an electrospun layer disposed over the substrate, the electrospun layer including a structure selected from a group consisting of a fiber-on-fiber structure, a bead-on-fiber structure, and a pop-corn structure, wherein the fuser member includes a top surface that is both hydrophobic and oleophobic.

According to various embodiments, there is a method of making a member of a fuser subsystem. The method can include providing a fuser member, the fuser member including a substrate. The method can also include electrospinning one or more polymeric materials to form an electrospun layer over the substrate, such that the electrospun layer can include a structure selected from a group consisting of a fiber-on-fiber structure, a bead-on-fiber structure, and a pop-corn structure, wherein a top surface of the fuser member is both hydrophobic and oleophobic.

According to another embodiment, there is a method of forming an image. The method can include providing a toner image on a media and providing a fuser subsystem including a fuser member, wherein the fuser member can include an electrospun layer disposed over a substrate, such that the electrospun layer includes a structure selected from a group consisting of a fiber-on-fiber structure, a bead-on-fiber structure, and a pop-corn structure, wherein a top surface of the fuser member is both hydrophobic and oleophobic. The method can also include feeding the media through the fuser subsystem, such that the toner image on the media contacts the top surface of the fuser member in a fusing nip and fusing the toner image onto the media by heating the fusing nip, wherein the hydrophobicity and oleophobicity of the top surface enables offset free and ghost free fusing.

Additional advantages of the embodiments will be set forth in part in the description which follows, and in part will be obvious from the description, or may be learned by practice of the invention. The advantages will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate embodiments of the invention and together with the description, serve to explain the principles of the invention.

DESCRIPTION OF THE EMBODIMENTS

Reference will now be made in detail to the present embodiments, examples of which are illustrated in the accompanying drawings. Wherever possible, the same reference numbers will be used throughout the drawings to refer to the same or like parts.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less that 10" can assume negative values, e.g. −1, −2, −3, −10, −20, −30, etc.

As used herein, the terms "hydrophobic" and "hydrophobicity" refer to the wettability of a surface (e.g., a coating surface) that has a water contact angle of approximately 90° or more and the terms "oleophobic" and "oleophobicity" refer to the wettability of a surface (e.g., a coating surface) that has a contact angle of approximately 90° or more when measured with hexadecane, hydrocarbon, and/or silicone oil. For example, on a surface that is both hydrophobic and oleophobic, both a water drop and a hexadecane drop of about 10-15 μl in volume can bead up and have an equilibrium contact angle of approximately 90° or greater.

Figure 1:
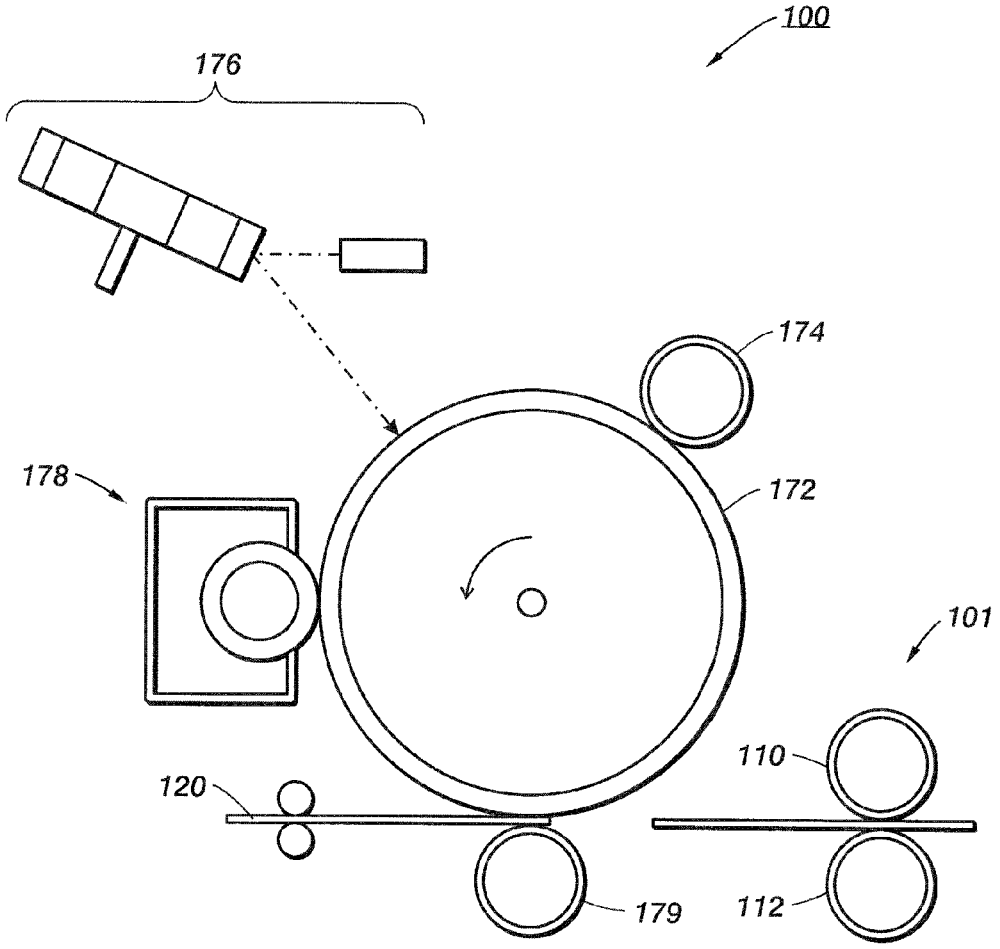
FIG. 1 schematically illustrates an exemplary printing apparatus, according to various embodiments of the present teachings.
Figure 9:
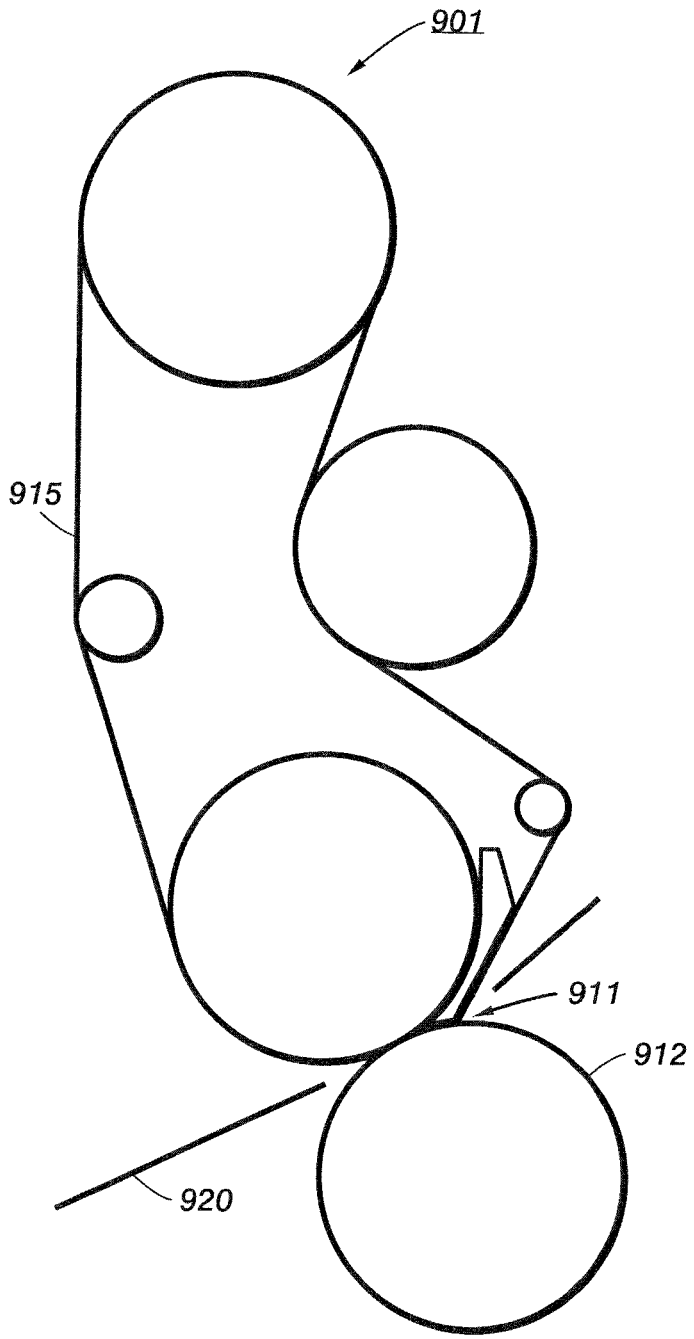
FIG. 9 schematically illustrates an exemplary fuser subsystem in a belt configuration, according to various embodiments of the present teachings.

FIG. 1 schematically illustrates an exemplary printing apparatus 100. The exemplary printing apparatus 100 can include an electrophotographic photoreceptor 172 and a charging station 174 for uniformly charging the electrophotographic photoreceptor 172. The electrophotographic photoreceptor 172 can be a drum photoreceptor as shown in FIG. 1 or a belt photoreceptor (not shown). The exemplary printing apparatus 100 can also include an imaging station 176 where an original document (not shown) can be exposed to a light source (also not shown) for forming a latent image on the electrophotographic photoreceptor 172. The exemplary printing apparatus 100 can further include a development subsystem 178 for converting the latent image to a visible image on the electrophotographic photoreceptor 172 and a transfer subsystem 179 for transferring the visible image onto a media 120. The printing apparatus 100 can also include a fuser subsystem 101 for fixing the visible image onto the media 120. The fuser subsystem 101 can include one or more of a fuser member 110, a pressure member 112, oiling subsystems (not shown), and a cleaning web (not shown), wherein the fuser member 110 and/or the pressure member 112 can have an electrospun layer as the top coat layer and wherein the fuser member 110 and/or the pressure member 112 can have a top surface that is both hydrophobic and oleophobic. In some embodiments, the top surface can have a contact angle of about 90° or greater when measured with at least one of hexadecane, hydrocarbon, and silicone oil. In other embodiments, the top surface can have a contact angle of about 120° or greater when measured with water. In some embodiments, the fuser member 110 can be a fuser roll 110, as shown in FIG. 1. In other embodiments, the fuser member 110 can be a fuser belt, 915, as shown in FIG. 9. In various embodiments, the pressure member 112 can be a pressure roll 112, as shown in FIG. 1 or a pressure belt (not shown).

Figure 2:
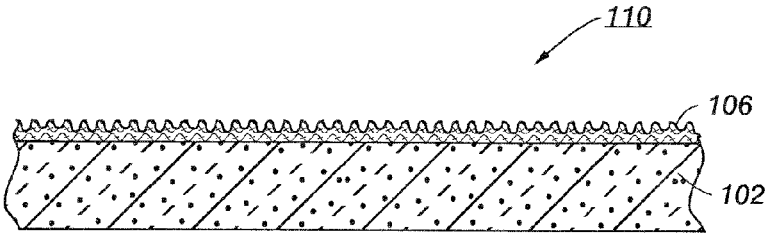
FIG. 2 schematically illustrates a cross section of an exemplary fuser member shown in FIG. 1, according to various embodiments of the present teachings.
Figure 3:
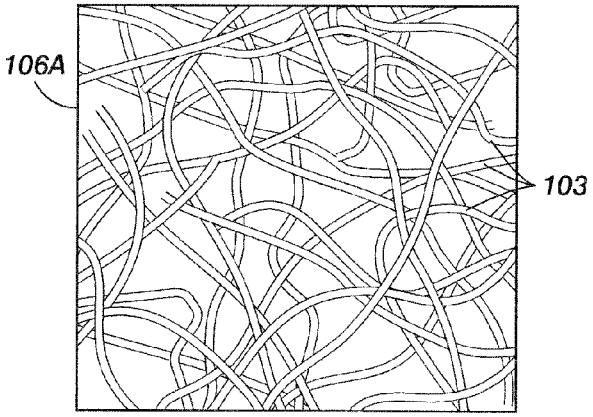
FIG. 3 schematically illustrates an exemplary electrospun layer including a fiber-on-fiber structure, according to various embodiments of the present teachings.
Figure 4:
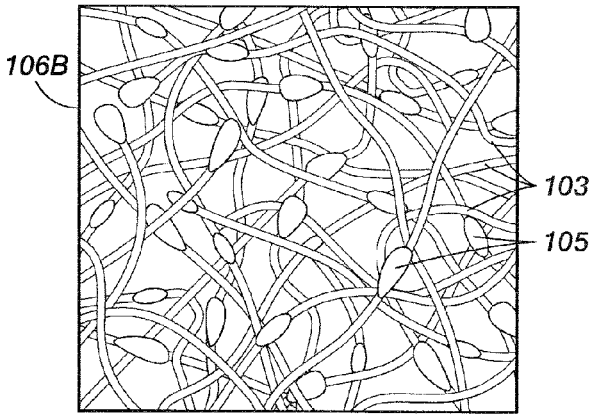
FIG. 4 schematically illustrates an exemplary electrospun layer including a bead-on-fiber structure, according to various embodiments of the present teachings.
Figure 5:
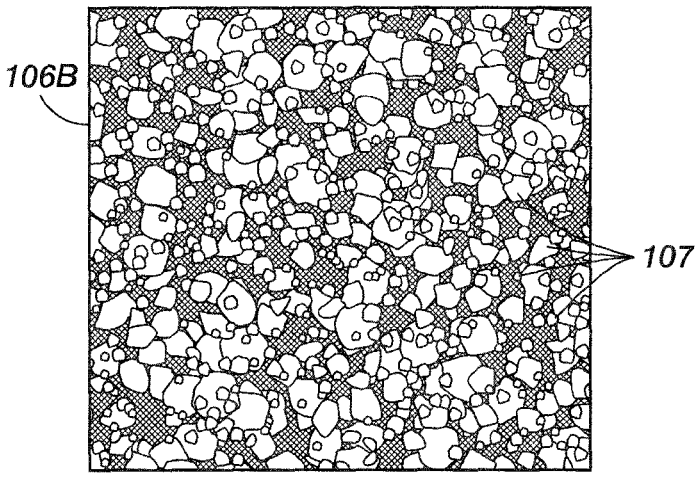
FIG. 5 schematically illustrates an exemplary electrospun layer including a pop-corn structure, according to various embodiments of the present teachings.
Figure 6:
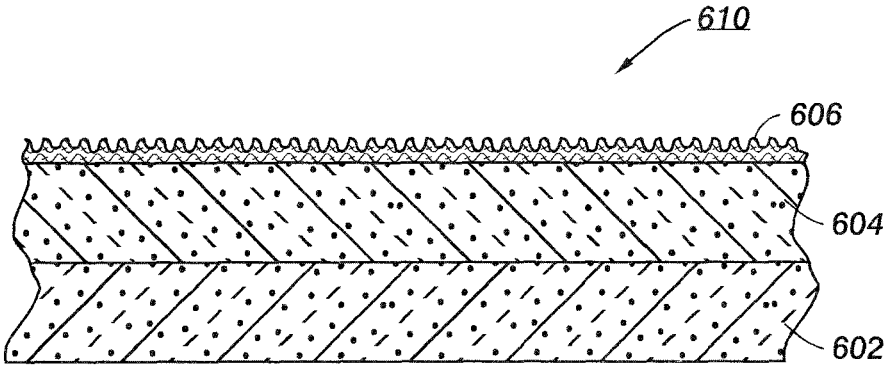
FIG. 6 schematically illustrates a cross section of another exemplary fuser member, according to various embodiments of the present teachings.
Figure 7:
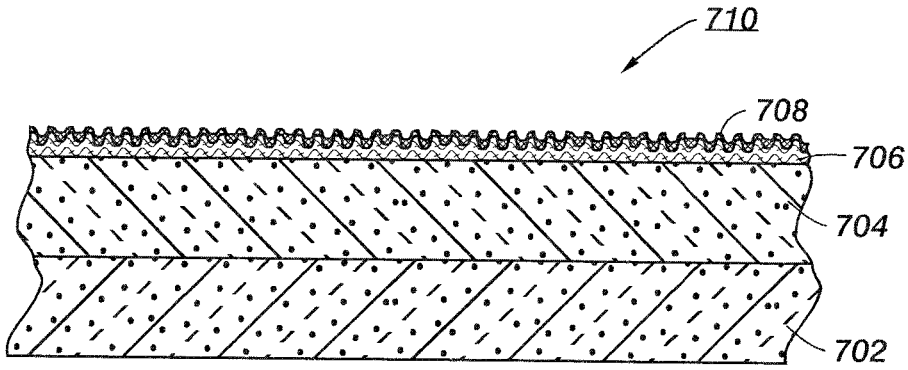
FIG. 7 schematically illustrates a cross section of yet another exemplary fuser member, according to various embodiments of the present teachings.
Figure 8:
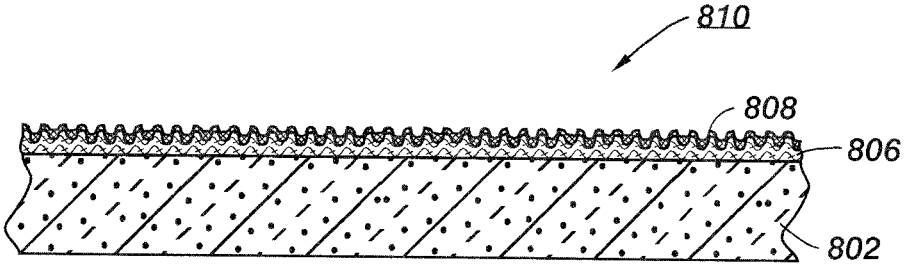
FIG. 8 schematically illustrates a cross section of yet another exemplary fuser member, according to various embodiments of the present teachings.

Referring back to the fuser member 110, each of the FIGS. 2, 6, 7, and 8 schematically illustrate a cross section of an exemplary fuser member 110, 610, 710, 810 in accordance with various embodiments of the present teachings. In some embodiments, the exemplary fuser member 110, 810 can include an electrospun layer 106, 806 disposed over a substrate 102, 802, as shown in FIGS. 2 and 8. In other embodiments, the exemplary fuser member 610, 710 can include an electrospun layer 606, 706 disposed over a compliant layer 604, 704 and wherein the compliant layer 604, 704 can be disposed over a substrate 602, 702, as shown in FIGS. 6 and 7. The electrospun layer 106, 606, 706, 806 can include a structure such as, for example, a fiber 103 on fiber 103 (fiber-on-fiber) structure 106A shown in FIG. 3, a bead 105 on fiber 103 (bead-on-fiber) structure 106B shown in FIG. 4, and a popcorn 107 structure 106C shown in FIG. 5. The electrospun fibers 103 can have a diameter in the range of about 1 nm to about 10 μm, and in some cases, in the range of about 10 nm to about 2 μm. The electrospun layer 106, 606, 706, 806 can also be porous having a porosity in the range of about 10% to about 99%, and in some cases from about 50% to about 95%, wherein the pores can have an average size in the range of about 50 nm to about 50 μm, and in some cases, in the range of about 100 nm to about 5 μm. In various embodiments, the electrospun layer 106, 606, 706, 806 can have a thickness from about 1 μm to about 5 mm, and in some embodiments, from about 5 μm to about 2 mm.

While not intending to be bound by any specific theory, it is believed that the hydrophobicity and oleophobicity of the electrospun layer 106, 606, 706, 806 can be controlled by the structure: fiber-on-fiber structure 106A, a bead-on-fiber structure 106B, and a popcorn structure 106C and the contact angle can be further fine tuned by adjusting the porosity, the size of pores, and electrospun fiber diameter. Furthermore, any suitable polymeric material, hydrophobic and/or hydrophilic material can be used to form the electrospun layer 106, 606, 706, 806, that is both hydrophobic and oleophobic. Exemplary polymeric materials can include, but are not limited to, one or more polymers selected from the group consisting of polystyrene; poly(vinyl alcohol); poly(ethylene oxide); polyacrylonitrile; polylactide; poly(caprolactone); poly(ether imide); polyurethanes; poly(ether urethanes); poly (ester urethanes); aliphatic polyamides; aromatic polyamides; poly(p-phenylene terephthalate); cellulose acetate; poly(vinyl acetate); poly(acrylic acid); polyacrylamide; polyvinylpyrrolidone;. hydroxypropylcellulose; poly(vinyl butyral); poly(alkyl acrylates); poly(alkyl methacrylates); polycarbonate; polyhydroxybutyrate; polyimides; poly(vinylidene fluoride); poly(vinylidene fluoride-co-hexafluoropropylene); fluorinated ethylene-propylene copolymer); poly (tetrafluoroethylene-co-perfluoropropyl vinyl ether); Teflon® PFA; and poly((perfluoroalkyl)ethyl methacrylate).

In certain embodiments, the electrospun layer 106, 606, 706, 806 can further include one or more additives to enhance one or more of the surface hydrophobicity and oleophobicity, mechanical strength, electrical conductivity, and thermal conductivity. The additives can be selected from the group consisting of carbon nanotubes, carbon nanofibers, silica, clay, and metal oxides nanoparticles, such as, for example, titanium oxide, aluminum oxide, and indium tin oxide.

In various embodiments, the compliant layer 604, 704, as shown in FIGS. 6 and 7, can include at least one of a silicone, a fluorosilicone, or a fluorelastomer. In some cases, the compliant layer 604 can have a thickness from about 10 μm to about 10 mm and in other cases from about 100 μm to about 5 mm.

In some embodiments, the fuser member 710, 810 can include a conformal layer 708, 808 disposed over the electrospun layer 706, 806 to further enhance the hydrophobocity and/or the oleophobicity of the electrospun layer 706, 806, wherein the conformal layer 708, 808 can include a hydrophobic material. Any suitable hydrophobic material can be used, such as, for example, fluorinated silane, (perfluoroalkyl)ethyl methacrylate, polytetrafluoroethylene, silicone, and fluorosilicone. In some cases, the conformal layer 608 can have a thickness from about 5 nm to about 150 nm and in other cases from about 20 nm to about 100 nm.

Referring back to the fuser member 110, 610, 710, 810, shown in FIGS. 2, 6, 7, and 8, in some embodiments, the substrate 102, 602, 702, 802 can be a high temperature plastic substrate, such as, for example, polyimide, polyphenylene sulfide, polyamide imide, polyketone, polyphthalamide, polyetheretherketone (PEEK), polyethersulfone, polyetherimide, and polyaryletherketone. In other embodiments, the substrate 102, 602, 702, 802 can be a metal substrate, such as, for example, steel and aluminum. The substrate 102, 602, 702, 802 can have any suitable shape such as, for example, a cylinder and a belt. The thickness of the substrate 102, 602, 702, 802 in a belt configuration can be from about 25 μm to about 250 μm, and in some cases from about 50 μm to about 125 μm. The thickness of the substrate 102, 602, 702, 802 in a cylinder or a roll configuration can be from about 0.5 mm to about 20 mm, and in some cases from about 1 mm to about 10 mm.

In various embodiments, the fuser member 110, 610, 710, 810 can also include one or more optional adhesive layers (not shown); the optional adhesive layers (not shown) can be disposed between the substrate 102, 602, 702, 802 and the one or more functional layers 106, 604, 606, 704, 706, 708, 806, 808 and/or between the one or more functional layers 106, 604, 606, 704, 706, 708, 806, 808 to ensure that each layer 106, 604, 606, 704, 706, 708, 806, 808 is bonded properly to each other and to meet performance target. Exemplary materials for the optional adhesive layer can include, but are not limited to epoxy resin and polysiloxane, such as THIXON 403/404, Union Carbide A-1100, Dow TACTIX 740™, Dow TACTIX 741™, Dow TACTIX 742™, and Dow H41™. In various embodiments, the pressure members 112, 912, 1012, as shown in FIGS. 1, 9, and 10 can also have a cross section as shown in FIGS. 2, 6, 7, and 8 of the exemplary fuser member 110, 610, 710, 810.

Referring back to the printing apparatus 100, the printing apparatus 100 can be a xerographic printer, as shown in FIG. 1. In certain embodiments, the printing apparatus 100 can be an inkjet printer (not shown).

FIG. 9 schematically illustrates an exemplary fuser subsystem 901 in a belt configuration of a xerographic printer. The exemplary fuser subsystem 901 can include a fuser belt 915 and a rotatable pressure roll 912 that can be mounted forming a fusing nip 911. In various embodiments, the fuser belt 915 and the pressure roll 912 can include an electrospun layer 106, 606, 706, 806 disposed over a substrate 102, 602, 702, 802 as shown in FIGS. 1, 6, 7, and 8, such that the electrospun layer 106, 606, 706, 806 can include a structure such as, for example, a fiber-on-fiber structure 106A shown in FIG. 3, a bead-on-fiber structure 106B shown in FIG. 4, and a popcorn structure 106C shown in FIG. 5. Furthermore, the fuser belt 915 and the pressure roll 912 can also include a top surface that is both hydrophobic and oleophobic. A media 920 carrying an unfused toner image can be fed through the fusing nip 911 for fusing.

Figure 10:
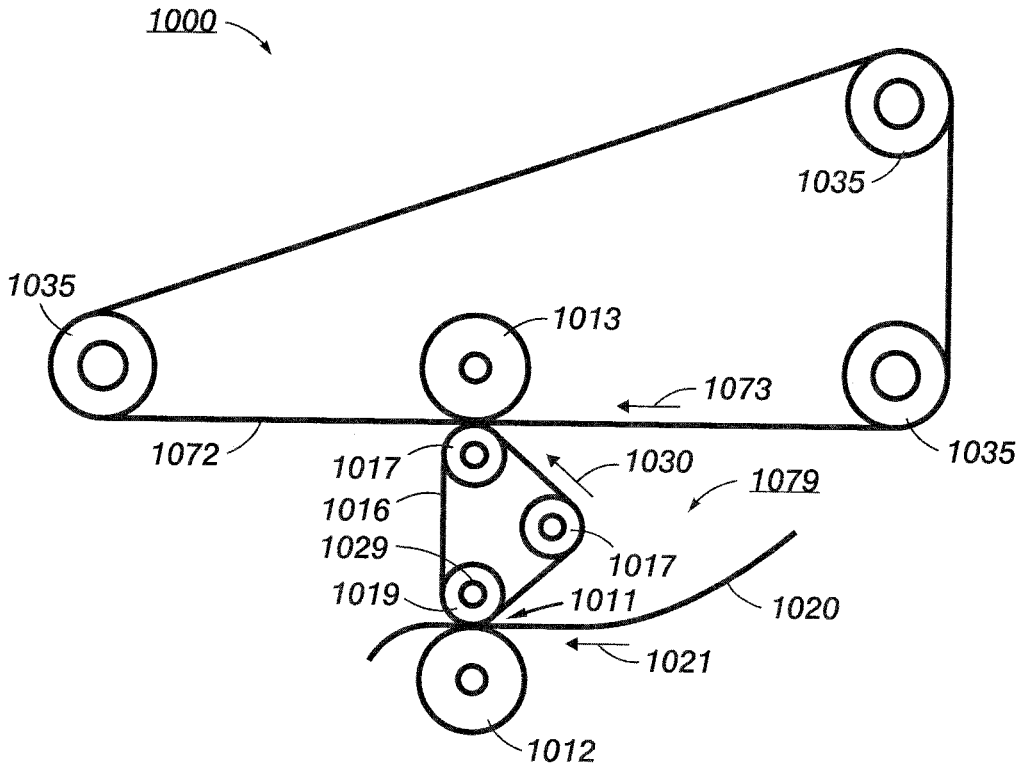
FIG. 10 illustrates an exemplary image development subsystem in a transfix configuration, according to various embodiments of the present teachings.

FIG. 10 illustrates an exemplary image development subsystem 1000 in a transfix configuration, according to various embodiments of the present teachings. In a transfix configuration, the transfer and fusing occur simultaneously. As shown in FIG. 10, a transfer subsystem 1079 can include a transfix belt 1016 held in position by two driver rollers 1017 and a heated roller 1019, the heated roller 1019 can include a heater element 1029. In various embodiments, the transfix belt 1016 can include an electrospun layer 106, 606, 706, 806 disposed over a substrate 102, 502, 602, such that the electrospun layer 106, 606, 706, 806 can include a structure such as, for example, a fiber-on-fiber structure 106A shown in FIG. 3, a bead-on-fiber structure 106B shown in FIG. 4, and a popcorn structure 106C shown in FIG. 5. The transfix belt 1016 can also include a top surface that is both hydrophobic and oleophobic. Referring back to the transfer subsystem 1079, the transfix belt 1016 can be driven by driving rollers 1017 in the direction of the arrow 1030. The developed image from photoreceptor 1072, which is driven in a direction 1073 by rollers 1035, can be transferred to the transfix belt 1016 when a contact between the photoreceptor 1072 and the transfix belt 1016 occurs. The image development subsystem 1000 can also include a transfer roller 1013 that can aid in the transfer of the developed image from the photoreceptor 1072 to the transfix belt 1016. In the transfix configuration, a media 1020 can pass through a fusing nip 1011 formed by the heated roller 1019 and the pressure roller 1012, and simultaneous transfer and fusing of the developed image to the media 1020 can occur. In some cases it may be necessary, optionally, to cool the transfix belt 1016 before it re-contacts the photoreceptor 1072 by an appropriate mechanism pre-disposed between the rollers 1017.

The disclosed exemplary fuser members 110, 610, 710, 810, 112, 915, 912, 1012, 1016 including an electrospun layer 106, 606, 706, 806, and a top surface that is both hydrophobic and oleophobic can be used in oil-less fusing processes to assist toner release and to enable, offset free and ghost free fusing. For example, due to the hydrophobic/oleophobic oil-less fuser surface, molten toner will fuse onto the medium rather than offsetting onto the fusing surface, resulting in offset free fusing. Moreover, in the cases, where waxy toners are used on a hydrophobic/oleophobic oil-less fuser surface, the oleophobicity can prevent wax from transferring onto the fuser surface and thus eliminating wax ghosting and other contaminations. Such oil-less fusing can provide many more advantages. For example, the elimination of the entire oil delivering system in fuser can provide lower manufacture cost, lower operating cost (e.g., due to no oil-replenishment), simpler fuser subsystem design and lighter weight. In addition, an oil-free fusing process/operation can overcome, e.g., non-uniform oiling of the fuser that generates print streaks and unacceptable image quality defect, and some machine reliability issue (e.g., frequent breakdown) that generates high service cost and customer dissatisfaction. Furthermore, the electrospinning process is known to be scalable.

Figure 11:
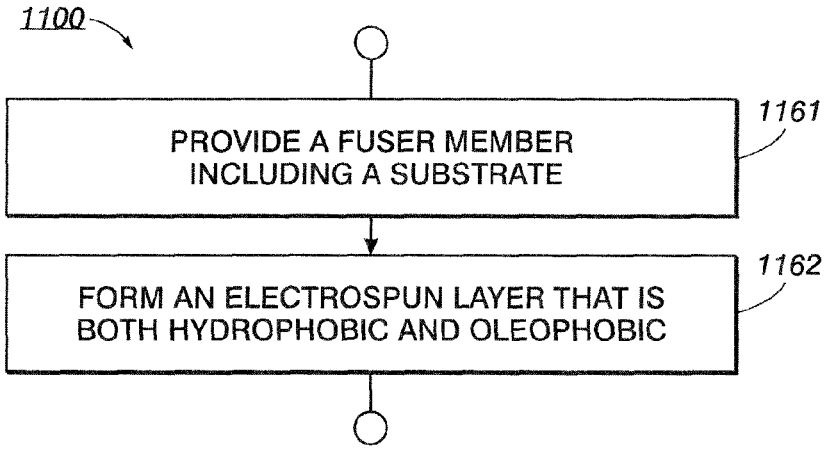
FIG. 11 shows an exemplary method of making a member of a fuser subsystem, according to various embodiments of the present teachings.

According to various embodiments, there is an exemplary method 1100 of making a member of a fuser subsystem, as shown in FIG. 11. The method 1100 can include a step 1161 of providing fuser member, the fuser member including a substrate and a step 1162 of electrospinning one or more polymeric materials to form an electrospun layer over the substrate, such that the electrospun layer includes a structure such as, for example, a fiber-on-fiber structure, a bead-on-fiber structure, and a popcorn structure, wherein a top surface of the fuser member is both hydrophobic and oleophobic. In various embodiments, the top surface can have a contact angle of about 90° or greater when measured with at least one of hexadecane, hydrocarbon, and silicone oil and a contact angle of about 120° or greater when measured with water.

Electrospinning is a well known technique. U.S. Patent Application Publication No. 20060292369 describes methods of preparation of superhydrophobic fibers by electrospinning, the disclosure of which is incorporated by reference herein in its entirety. Furthermore, electrospinning in general and in particular, methods for the preparation of ultrathin fibers by electrospinning are disclosed in a review article by Andreas Greiner and Joachim H. Wendorff in Angew. Chem. Int. Ed. 2007, 46, 5670-5703, the disclosure of which is incorporated by reference herein in its entirety.

In certain embodiments, the step 1162 of electrospinning one or more polymeric materials to form an electrospun layer over the substrate can include electrospinning one or more polymers, including, but not limited to poly(vinyl alcohol); poly(ethylene oxide); polyacrylonitrile; polylactide; poly(caprolactone); poly(ether imide); polyurethanes; poly(ether urethanes); poly(ester urethanes); aliphatic polyamides; aromatic polyamides; poly(p-phenylene terephthalate); cellulose acetate; poly(vinyl acetate); poly(acrylic acid); polyacrylamide; polyvinylpyrrolidone; hydroxypropylcellulose; poly(vinyl butyral); poly(alkyl acrylates); poly(alkyl methacrylates); polycarbonate; polyhydroxybutyrate; polyimides; poly(vinylidene fluoride); poly(vinylidene fluoride-co-hexafluoropropylene); fluorinated ethylene-propylene copolymer); poly(tetrafluoroethylene-co-perfluoropropyl vinyl ether); Teflon® PFA; and poly((perfluoroalkyl)ethyl methacrylate). In some cases, depending upon the polymeric material, the solvent for electrospinning can be aqueous or organic solvent or a mixture of aqueous and organic solvents. In other cases melt electrospinning can be performed using no solvent. Furthermore, depending upon the processing conditions, such as solvent, solution concentration, temperature, voltage and so on, the diameter of the fiber, the average pore size and the porosity of the electrospun layer can be controlled. In some embodiments, the step 1162 of electrospinning one or more polymeric materials to form electrospun fibers can result in electrospun fibers having a diameter in the range of about 1 nm to about 10 μm, and in some cases, in the range of about 10 nm to about 2 μm. In other embodiments, the step 1162 of electrospinning one or more polymeric materials can result in porous electrospun layer including pores having an average size in the range of about 50 nm to about 50 μm, and in some cases, in the range of about 100 nm to about 5 μm. In some other embodiments, the step 1162 of electrospinning one or more polymeric materials can result in porous electrospun layer having a porosity in the range of about 10% to about 99%, and in some cases from about 50% to about 95%.

In various embodiments, the step 1162 of electrospinning one or more polymeric materials over the substrate can also include forming a compliant layer over the substrate, wherein the compliant layer can include at least one of a silicone, a fluorosilicone, or a fluorelastomer and electrospinning one or more polymeric materials over the compliant layer. In certain embodiments, the method 1100 can also include a step of forming a conformal layer over the electrospun layer to further enhance the hydrophobicity and oleophobcity of the electrospun layer. The conforming layer can include any suitable hydrophobic material, such as, for example, fluorinated silane, (perfluoroalkyl)ethyl methacrylate, polytetrafluoroethylene, silicone, and fluorosilicone. The conformal layer can be formed by any suitable technique, such as, for example, initiated chemical vapor deposition (iCVD) and molecular vapor deposition. U.S. Patent Application Publication No. 20070237947 describes methods of preparation of superhydrophobic fibers by electrospinning and initiated chemical vapor deposition (iCVD), the disclosure of which is incorporated by reference herein in its entirety.

Figure 12:
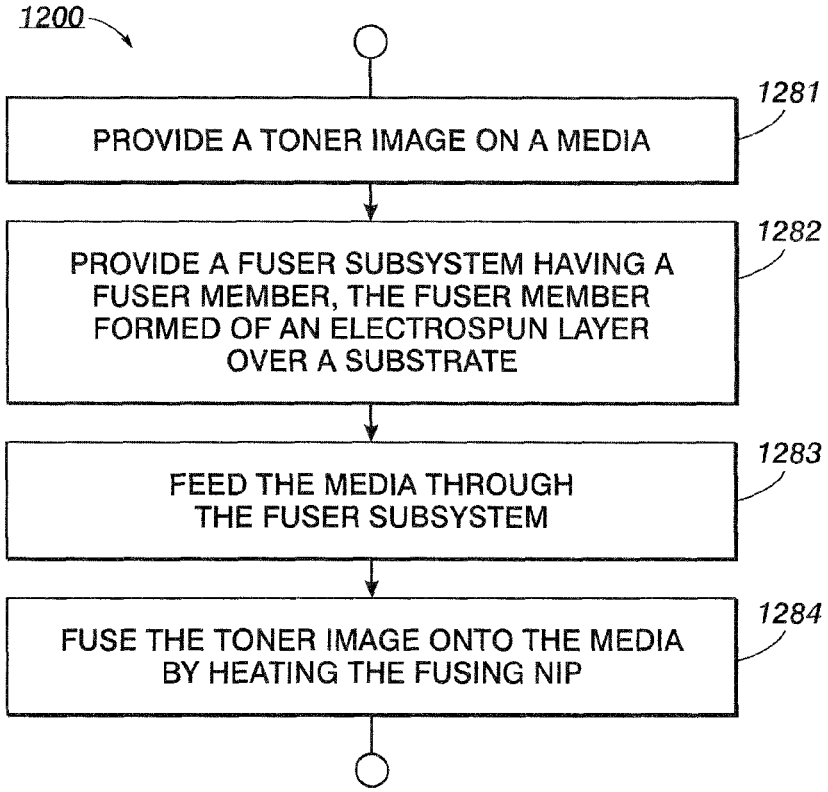
FIG. 12 shows an exemplary method of forming an image, according to various embodiments of the present teachings.

FIG. 12 shows an exemplary method 1200 of forming an image, according to various embodiments of the present teachings. The method 1200 can include providing a toner image on a media, as in step 1281. The method 1200 can also include a step 1282 of providing a fuser subsystem including a fuser member, wherein the fuser member can include an electrospun layer disposed over a substrate, such that the electrospun layer includes a structure, such as, for example, a fiber-on-fiber structure, a bead-on-fiber structure, and a pop-corn structure, wherein a top surface of the fuser member is both hydrophobic and oleophobic. In some embodiments, the step 1282 of providing a fuser subsystem can include providing the fuser subsystem in a roller configuration. In other embodiments, the step 1282 of providing a fuser subsystem can include providing the fuser subsystem in a belt configuration. In various embodiments, the fuser member of the fuser subsystem can include one or more of a fuser roll, a fuser belt, a pressure roll, a pressure belt, a transfix roll, and a transfix belt. The method 1200 can further include a step 1283 of feeding the media through the fuser subsystem, such that the toner image on the media contacts the top surface of the fuser member in a fusing nip and a step 1284 of fusing the toner image onto the media by heating the fusing nip, wherein the hydrophobicity and oleophobicity of the top surface enables offset free and ghost free fusing.

While the invention has been illustrated respect to one or more implementations, alterations and/or modifications can be made to the illustrated examples without departing from the spirit and scope of the appended claims. In addition, while a particular feature of the invention may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." As used herein, the term "one or more of" with respect to a listing of items such as, for example, A and B, means A alone, B alone, or A and B.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A fuser subsystem comprising:

a fuser member, the fuser member comprising:

a substrate; and an electrospun layer disposed over the substrate, the electrospun layer comprising a structure selected from the group consisting of a fiber-on-fiber structure, a bead-on-fiber structure, and a pop-corn structure, wherein the fuser member comprises a top surface that is both hydrophobic and oleophobic, wherein the electrospun layer has a porosity in the range of about 50% to about 95%, wherein the electrospun layer comprises fibers having a diameter in the range of about 1 nm to about 10 nm wherein the top surface has a contact angle of about 90° or greater when measured with hexadecane, hydrocarbon, or silicone oil and a contact angle of about 120° or greater when measured with water, and wherein the electrospun layer comprises more than one polymer selected from the group consisting of polystyrene; poly(vinyl alcohol); poly(ethylene oxide); polyacrylonitrile; polylactide; poly(caprolactone); poly(ether imide); polyurethanes; poly(ether urethanes); poly(ester urethanes); poly(p-phenylene terephthalate); cellulose acetate; poly(vinyl acetate); poly(acrylic acid); polyacrylamide; polyvinylpyrrolidone; hydroxypropylcellulose; poly(vinyl butyral); poly(alklyl acrylates); polyhydroxybutyrate; poly(vinylidene fluoride); poly(vinylidene fluoride-co-hexafluoropropylene); fluorinated ethylene-propylene copolymer); poly(tetrafluoroethylene-co-perfluoroalkyl vinyl ether); and poly((perfluoroalkyl) ethyl methacrylate).

2. The fuser subsystem of claim 1, wherein the electrospun layer comprises pores having an average size in the range of about 50 nm to about 50 μm.

3. The fuser subsystem of claim 1, wherein the electrospun layer further comprises an additive selected from the group consisting of silica, clay, metal oxides nanoparticles, carbon nanotubes, and carbon nanofibers.

4. The fuser subsystem of claim 1 further comprising a conformal layer disposed over the electrospun layer, the conformal layer comprising a material selected from the group consisting of fluorinated silane, (perfluoroalkyl)ethyl methacrylate, polytetrafluoroethylene, silicone, and fluorosilicone.

5. The fuser subsystem of claim 1, wherein the fuser member comprises one or more of a fuser roll, a fuser belt, a pressure roll, a pressure belt, a transfix roll, and a transfix belt.

6. A printing apparatus comprising the fuser subsystem of claim 1.

7. The printing apparatus of claim 6, wherein the printing apparatus is one of a xerographic printer or a solid inkjet printer.

* * * * *